US006209529B1

(12) United States Patent
Everingham

(10) Patent No.: US 6,209,529 B1
(45) Date of Patent: Apr. 3, 2001

(54) INJECTOR EGR VALVE AND SYSTEM

(75) Inventor: Gary M. Everingham, Chatham (CA)

(73) Assignee: Siemens Canada Limited, Mississauga (CA)

( * ) Notice: Subject to any disclaimer, the term of this patent is extended or adjusted under 35 U.S.C. 154(b) by 0 days.

(21) Appl. No.: 09/542,645

(22) Filed: Apr. 3, 2000

Related U.S. Application Data

(63) Continuation of application No. 09/107,514, filed on Jun. 30, 1998.

(51) Int. Cl.[7] ..... F02M 25/07
(52) U.S. Cl. ..... 123/568.2; 123/568.21
(58) Field of Search ..... 123/568.11, 568.12, 123/568.13, 568.14, 568.2, 568.21

(56) References Cited

U.S. PATENT DOCUMENTS

| | | | | |
|---|---|---|---|---|
| 3,703,164 | | 11/1972 | Weaving | 123/568.2 |
| 4,109,625 | * | 8/1978 | Kawamura et al. | 123/568.13 |
| 4,276,865 | | 7/1981 | Hamai | 123/568.2 |
| 4,363,097 | | 12/1982 | Amano | 701/114 |
| 4,463,740 | | 8/1984 | Sagisaka et al. | 123/568.15 |
| 4,615,324 | | 10/1986 | Choushi et al. | 123/568.17 |
| 4,628,888 | | 12/1986 | Duret | 123/531 |
| 5,115,790 | | 5/1992 | Kawamura | 123/568.2 |
| 5,494,255 | | 2/1996 | Pearson et al. | 251/129.15 |
| 5,669,364 | | 9/1997 | Everingham | 123/568.18 |
| 5,746,189 | | 5/1998 | Kuzuya et al. | 123/568.15 |
| 5,746,190 | | 5/1998 | Honda | 123/568.18 |
| 5,749,563 | | 5/1998 | Hosaka et al. | 123/568.29 |
| 5,762,051 | | 6/1998 | Okamoto | 123/568.18 |
| 5,782,226 | * | 7/1998 | Gartner | 123/568.13 |

FOREIGN PATENT DOCUMENTS

| | | |
|---|---|---|
| 195 41 362 | 1/1997 | (DE) . |
| 196 21 530 | 6/1997 | (DE) . |
| 0 275 169 | 7/1988 | (EP) . |
| 0 509 189 | 10/1992 | (EP) . |
| 0 811 762 | 12/1997 | (EP) . |
| WO 99 15773 | 4/1999 | (WO) . |

OTHER PUBLICATIONS

International Search Report mailed Jan. 14, 2000 for International Application No. PCT/CA99/00609.

* cited by examiner

*Primary Examiner*—Willis R. Wolfe

(57) ABSTRACT

An internal combustion engine has multiple combustion chambers each having intake and exhaust valves for controlling intake and exhaust flows into and from the combustion chamber, an induction system to the intake valves, an exhaust system from the exhaust valves, and an EGR system for controlling recirculation of exhaust flow to the combustion chambers. The EGR system has an individual electric-actuated EGR valve associated with each respective combustion chamber for controlling the exhaust recirculation to the respective combustion chamber independent of the exhaust gas recirculated to any other combustion chamber. The EGR valves are mounted in an exhaust gas recirculation rail assembly that is assembled to the engine. Each EGR valve is operated according to mapped EGR requirements for the respective combustion chamber.

10 Claims, 5 Drawing Sheets

INJECTOR EGR VALVE AND SYSTEM

This application is a continuation of U.S. Ser. No. 09/107,514, filed on Jun. 30, 1998.

FIELD OF THE INVENTION

This invention relates to exhaust gas recirculation (EGR) valves and systems for automotive vehicle internal combustion engines.

BACKGROUND OF THE INVENTION

Controlled engine exhaust gas recirculation is a known technique for reducing oxides of nitrogen in products of combustion that are exhausted from an internal combustion engine to atmosphere. A typical EGR system comprises an EGR valve that is controlled in accordance with engine operating conditions to regulate the amount of engine exhaust gas that is recirculated to the fuel-air flow entering the engine for combustion so as to limit the peak combustion temperature and hence reduce the formation of oxides of nitrogen.

Exhaust emission requirements have been imposing increasingly stringent demands on tailpipe emissions that may be met by improved control of EGR valves. An electromagnetically operated actuator controlled by an engine management computer is one device for obtaining improved EGR valve control. It is known to associate such a valve with an engine intake manifold to dope the induction flow before the flow passes to runners to each individual cylinders.

It is also known to provide each cylinder with a strictly mechanical mechanism to recirculate exhaust gas from a cylinder back to the intake of the cylinder.

SUMMARY OF THE INVENTION

One aspect of the present invention relates to an internal combustion engine having multiple combustion chambers each having intake and exhaust valves for controlling intake and exhaust flows into and from the combustion chamber, an induction system to the intake valves, an exhaust system from the exhaust valves, and an EGR system for controlling recirculation of exhaust flow to the combustion chambers comprising an individual electric-actuated EGR valve associated with each respective combustion chamber for controlling the exhaust recirculation to the respective combustion chamber independent of the exhaust gas recirculated to any other combustion chamber.

Another aspect of the present invention relates to an internal combustion engine having multiple combustion chambers, an exhaust system through which exhaust gas is conducted from the combustion chambers, and an exhaust gas recirculation rail assembly mounted on the engine, the exhaust gas recirculation rail assembly comprising an exhaust gas recirculation rail forming an exhaust gas recirculation manifold communicated to the exhaust system, plural electric-actuated EGR valves mounted on the rail, each comprising its own inlet port communicated to the exhaust gas recirculation manifold and its own outlet port for recirculation of exhaust gas from the exhaust system to a respective combustion chamber such that recirculation of exhaust gas through each valve is controlled independent of the exhaust gas recirculated through the other valves.

Still another aspect of the present invention relates to a method of exhaust gas recirculation in an internal combustion engine having multiple combustion chambers each having intake and exhaust valves for controlling intake and exhaust flows into and from the combustion chamber, an induction system to the intake valves, an exhaust system from the exhaust valves, an EGR system for controlling recirculation of exhaust flow from the exhaust system to the combustion chambers comprising an individual electric-actuated EGR valve associated with each respective combustion chamber for controlling the exhaust recirculation to the respective combustion chamber independent of the exhaust gas recirculated to any other combustion chamber, and an electric controller for controlling each valve individually in relation to one or more input parameters to the electric controller, the method comprising controlling individual EGR valve operation through a respective map of the respective combustion chamber's EGR requirements that is contained in the electric controller.

Still another aspect of the present invention relates to an EGR valve comprising a ferromagnetic shell comprising a cylindrical side wall, a transverse end wall at an axial end of the side wall, the end wall containing a valve seat circumscribing a first port, a second port in the side wall proximate the end wall, a valve element that is selectively positionable relative to the valve seat to selectively control EGR flow between the two ports, the side wall comprising an internal shoulder spaced beyond the second port relative to the end wall, a shield disposed within the shell and having an outer margin seated on the shoulder and an inner margin circumscribing the valve element, the inner margin being spaced toward the end wall relative to the outer margin, a bearing guide disposed within the shell seated on the outer margin of the shield and providing guidance for the valve element, a first ferromagnetic pole piece disposed within the shell against the bearing guide, an electromagnet coil disposed within the shell beyond the first pole piece relative to the bearing guide, a second ferromagnetic pole piece disposed within the shell and cooperating with the first pole piece to axially capture the coil, and with the shell side wall, form a solenoid, the solenoid further comprising an armature reciprocal within the coil and joined to the valve element, and a cap closing the end of the shell opposite the end wall.

Still another aspect of the present invention relates to an exhaust gas recirculation rail assembly comprising an exhaust gas recirculation rail forming an exhaust gas recirculation manifold adapted to be communicated to exhaust gas from an internal combustion engine, plural electricactuated EGR valves mounted on the rail, each comprising its own inlet port communicated to the exhaust gas recirculation manifold and its own outlet port, each outlet port adapted to be communicated to a respective engine combustion chamber to provide for controlled recirculation of exhaust gas to a respective combustion chamber independent of exhaust gas recirculated to other combustion chambers.

BRIEF DESCRIPTION OF THE DRAWINGS

The accompanying drawings, which are incorporated herein and constitute part of this specification, include one or more presently preferred embodiments of the invention, and together with a general description given above and a detailed description given below, serve to disclose principles of the invention in accordance with a best mode contemplated for carrying out the invention.

DESCRIPTION OF THE PREFERRED EMBODIMENT

Figure 1:
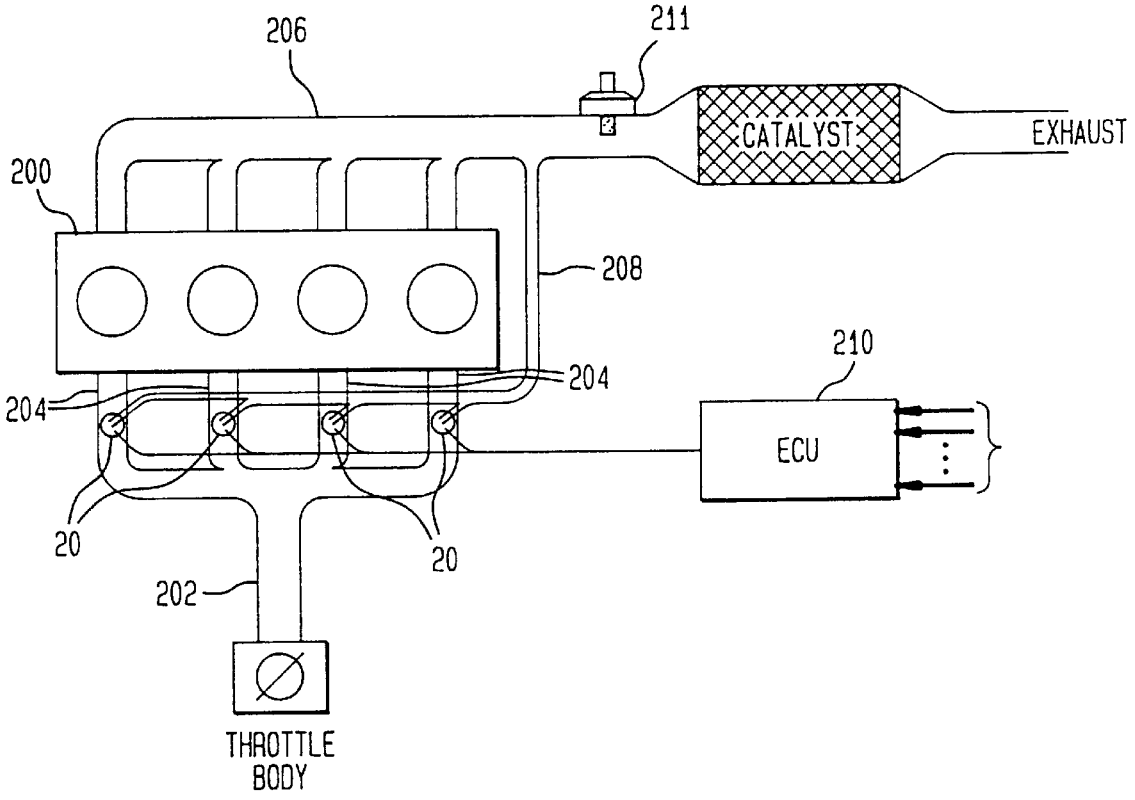
FIG. 1 is a schematic diagram of an internal combustion engine comprising an injector EGR system according to the present invention.

FIG. 1 shows a portion of a multi-cylinder internal combustion engine 200 that includes injector EGR valves 20 embodying principles of the present invention. Engine 200 comprises an intake system 202 comprising runners 204 through which combustible fuel-air charges are introduced into the engine cylinders at proper times during the engine cycle, then combusted in the cylinders to power the engine, and finally exhausted through an exhaust system 206. A conduit 208 is tapped into exhaust system 206 to supply exhaust gas to EGR valves 20. Each EGR valve 20 controls the introduction of exhaust gas into a respective runner 204 leading to a respective cylinder.

An engine management computer 210, sometimes referred to as an electronic control unit or ECU, receives various input signals related to engine operation, processes certain of these signals according to stored algorithms, and issues control signals to EGR valves 20. Each EGR valve 20 is opened by the corresponding control signal during a portion of the intake stroke of the corresponding engine cylinder, causing a controlled amount of exhaust gas to dope the incoming fuel-air charge. By placing an individual electric-actuated EGR valve 20 in association with each cylinder, the EGR doping of each cylinder may be controlled independent of the EGR doping of the others, and this allows EGR flow to each cylinder to be uniquely tailored to the particular requirements of a cylinder. This procedure can be beneficial to attainment of compliance with relevant exhaust gas emission regulations and/or specifications.

Figure 2:
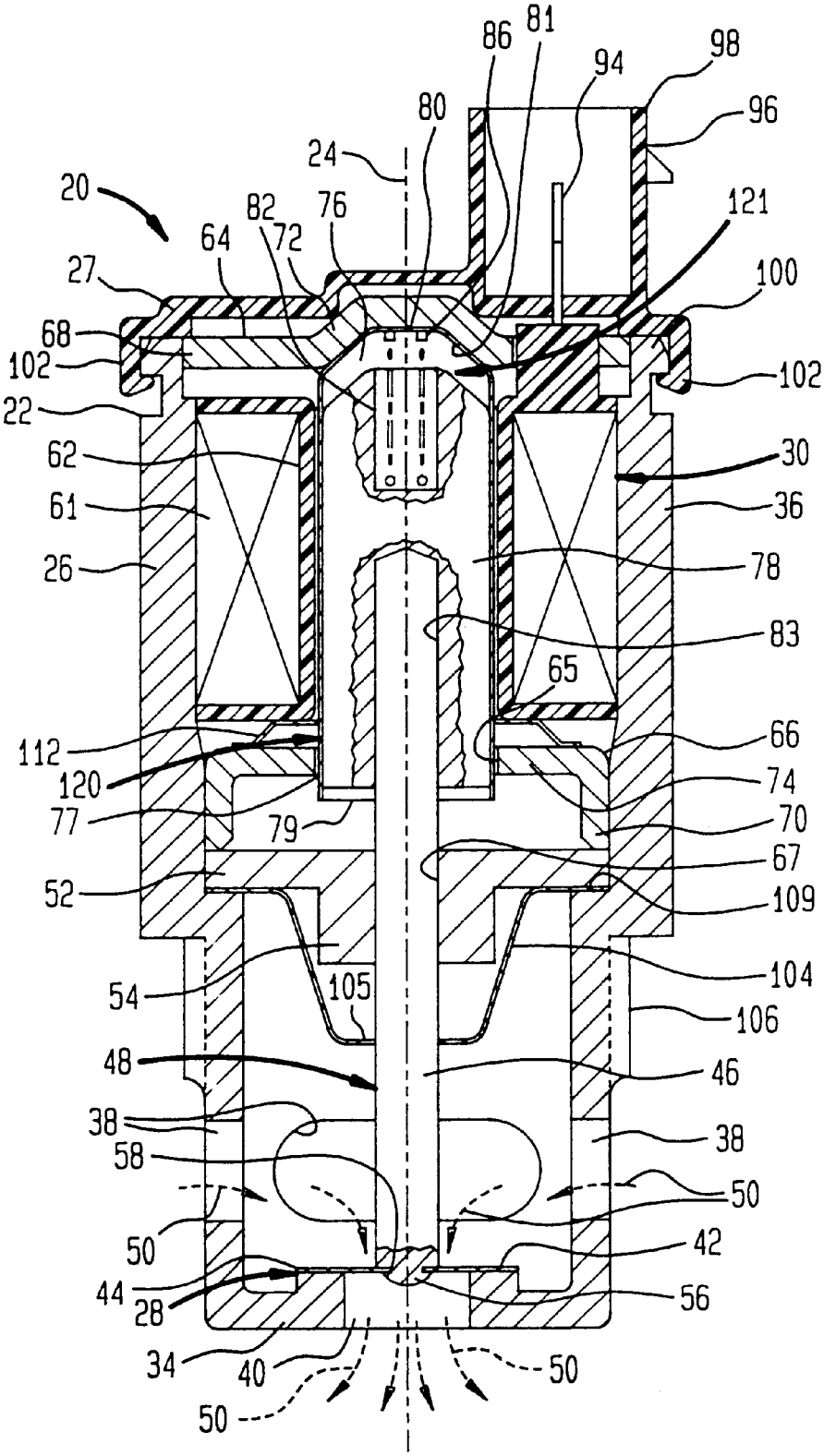
FIG. 2 is a longitudinal cross section view through an embodiment of injector EGR valve used in the injector EGR system of FIG. 1.

FIG. 2 shows an embodiment of EGR valve 20 to comprise a body 22 having an imaginary longitudinal axis 24. Body 22 comprises a walled ferromagnetic shell 26 coaxial with axis 24, a non-metallic end cap 27 closing an otherwise open axial end of shell 26, a valve mechanism 28 at the opposite axial end of shell 26, and a solenoid actuator 30 within shell 26 for operating valve mechanism 28. At its axial end that contains valve mechanism 28, shell 26 comprises a circular end wall 34. Shell 26 further comprises a circular cylindrical side wall 36 extending from end wall 34 to cap 27. Several through-holes in side wall 36 proximate end wall 34 form an inlet port 38 of valve 20. At the center of end wall 34, shell 26 has a circular through-hole forming an outlet port 40. A radially inner margin of end wall 36 surrounding outlet port 40 comprises an inward turned circular lip that provides a circular valve seat 42 of valve mechanism 28. A circular flat disk 44 and a cylindrical pin 46 form a valve element 48 of valve mechanism 28.

Valve element 48 is disposed in association with solenoid actuator 30 and valve seat 42 for selectively opening and closing a flow path through a portion of the interior of valve body 22 between inlet port 38 and outlet port 40. The flow path and direction of flow are depicted by arrows 50. FIG. 2 shows the radially outer margin of disk 44 seating on valve seat 42, closing the flow path.

A bearing 52 of suitable bearing material is disposed within shell 26 for guiding the travel of valve element 48. Bearing 52 has a circular shape whose outer perimeter is fitted to the inner surface of side wall 36 proximate inlet port 38. At its center, bearing 52 has a hub 54 containing a circular through-hole that is coaxial with axis 24. Pin 46 passes through this through-hole with a close sliding fit by virtue of which bearing 52 guides valve element 48 for travel along axis 24.

At one end, pin 46 has a neck 56 that passes through a small through-hole 58 in the center of disk 44. The two parts are united by a joint that may be created by deforming the end of neck 56 against the margin of hole 58 at one face of disk 44 to force the margin of hole 58 at the opposite disk face against a shoulder at the junction of neck 56 and pin 46.

Solenoid actuator 30 comprises an electromagnet coil 61 disposed on a non-metallic bobbin 62 coaxial with axis 24 within shell 26. Actuator 30 also comprises a stator that includes two ferromagnetic pole pieces 64, 66 that are disposed respectively at respective opposite ends of coil 61 and bobbin 62. Respective outer perimeters 68, 70 of pole pieces 64, 66 respectively, are fitted to side wall 36 at locations spaced axially along shell 26. Pole piece 64 is imperforate while pole piece 66 has a circular through-hole 65 at its center.

Actuator 30 further comprises a ferromagnetic armature 78 having a generally cylindrical shape arranged coaxial with axis 24. A circular, cylindrical sleeve 79 of non-ferromagnetic material, a non-magnetic stainless steel for example, is disposed within the bore of bobbin 62 coaxial with axis 24 to provide guidance for axial travel of armature 78. One end of sleeve 79 is open to allow armature 78 to enter; the other end 80 is closed. This closed end 80 has a taper for seating within a similarly tapered depression 81 centrally formed in pole piece 64. The axial end of armature 78 that confronts closed end 80 also has a similarly tapered shape, and at its center, a blind hole 82. The opposite axial end of armature 78 has a blind hole 83 at its center. The end of pin 46 opposite neck 56 is received in hole 83 where the pin and armature are joined.

One axial end of a helical, compression, armature-bias spring 86 is received in blind hole 83. The opposite end of the spring bears against closed end 80 of sleeve 79. In this way, spring 86 biases armature 78 to seat the outer margin of disk 44 on seat 42 thereby closing the flow path through valve 20 between ports 38 and 40.

Coil 61 comprises magnet wire wound around bobbin 62. Respective terminations of the magnet wire are electrically joined to respective electric terminals 94 mounted on bobbin 62. Free ends of terminals 94 protrude through end cap 27 where they are girdled by a surround 96 formed in end cap 27 to create an electric connector 98 to which a mating connector (not shown) may be connected to place coil 61 as a load in an electric control circuit for operating valve 20. Such a circuit is part of the controller, or engine management computer, depicted by the block 210 in FIG. 1.

The upper end of shell 26 has an outward turned lip 100 onto which end cap 27 is snapped and retained in place by one or more catches 102 on the cap rim. One further part of valve 20 is a circular, cup-shaped shield 104 whose outer perimeter seats on an internal shoulder 109 of shell 26. The outer perimeter margin of bearing 52 in turn seats on the outer perimeter margin of shield 104. A ring-shaped wave spring 112 is disposed circumferentially about pin 46 to act between bearing 52 and bobbin 62 to maintain to the described relationship of internal parts within the interior of shell 26.

Shield 104 is imperforate except for a hole 105 at its center providing clearance to pin 46. Shield 104 aids in directing hot exhaust gas flow passing through valve 20, deflecting the gas and heat away from actuator 30. The various internal parts of valve 20 fit together in a manner that prevents exhaust gas from intruding past actuator 30 and escaping to atmosphere.

The exterior of side wall 36 slightly beyond inlet port 38 relative to end wall 34 contains a screw thread 106 via which body 22 is threaded into a complementary threaded mounting hole in an engine in a gas-tight manner to place inlet port 38 in communication with engine exhaust gas and outlet port 40 in communication with induction flow into a corresponding engine cylinder, such as by communication with a runner 204.

Pole pieces 64, 66, the intervening portion of shell 36, and armature 78 form a somewhat torroidal-shaped magnetic circuit that includes a circular annular air gap 120 between the armature and pole piece 66 at hole 65 and a larger air gap 121 between the opposite end of the armature and pole piece 64. The magnetic circuit extends from one side of air gap 121, through pole piece 64, through side wall 36, through pole piece 66, across air gap 120 to armature 78, and through the armature back to the other side of air gap 121.

When actuator 30 is energized by flow of electric current in coil 61, an electromagnetic force acts on armature 78 in an axial direction away from outlet port 40. A sufficiently large current flow creates a force that is sufficiently large to overcome the bias of spring 86. This imparts travel to valve element 48 in the direction of unseating from valve seat 42 thereby opening valve 20. Exhaust gas can now pass from inlet port 38 along the flow path represented by arrows 50 and exit through outlet port 40. When the current terminates, spring 86 re-closes valve 20 by re-seating valve element 48 on valve seat 42.

Figure 3:
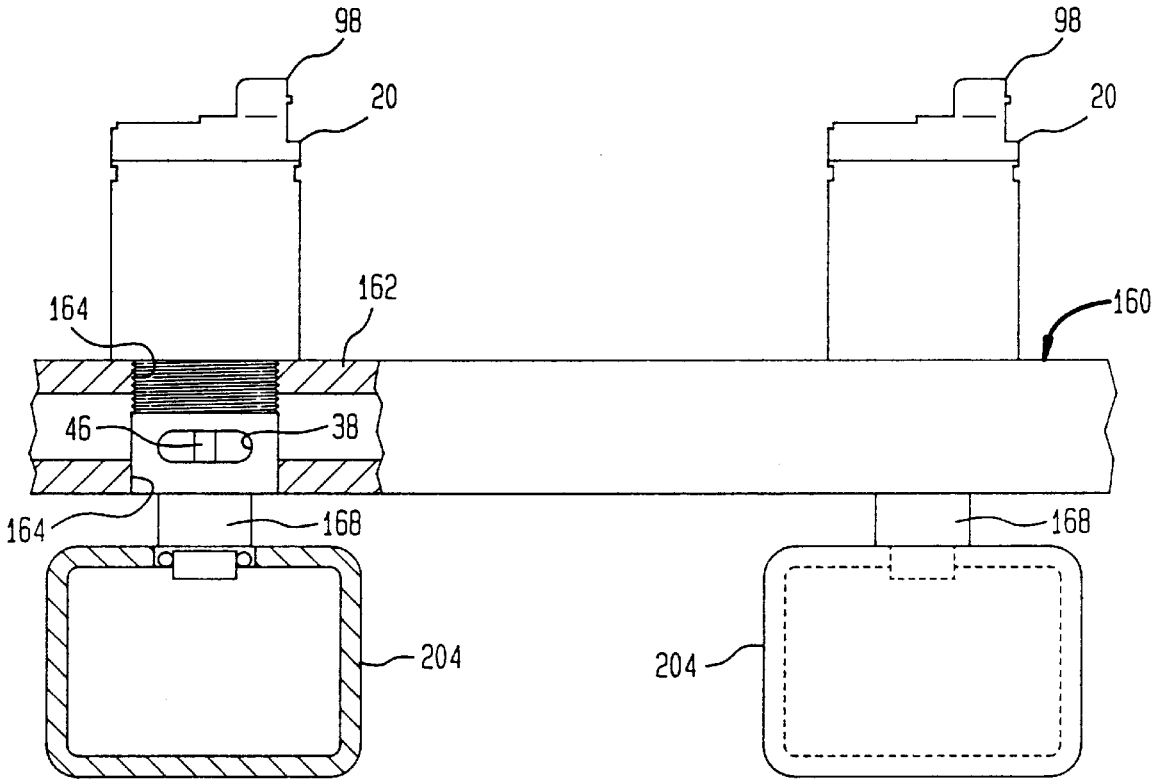
FIG. 3 is a fragmentary elevational view, partly in cross section, of an assembly containing a number of injector EGR valves for a corresponding number of engine cylinders and adapted to be mounted on an engine.

Because each EGR valve 20 injects only an amount of exhaust gas needed for one engine cylinder, it can be made relatively small and compact. The valve can be mounted in an exhaust gas recirculation rail to form an exhaust gas recirculation rail assembly that can be mounted on an engine to associate each injector EGR valve outlet port with a respective cylinder intake runner. FIG. 3 shows such an exhaust gas recirculation rail assembly 160.

Exhaust gas recirculation rail assembly 160 comprises a rail member 162 containing a number of individual injector EGR valves 20 corresponding to a like number of engine cylinders. For example, a four-cylinder in-line engine would have a rail member 162 containing four mounting sockets 164 at suitable locations along its length. Each socket comprises aligned holes through opposite portions of the wall of member 162, one being threaded to receive the valve thread 106. Each valve 20 is mounted in a respective socket 164 to place each valve's inlet port 38 in communication with the interior of rail member 162. The mounting is gas-tight so that exhaust gas does not leak to atmosphere. The interior of rail member 162 is effectively a manifold to which conduit 208 supplies hot engine exhaust gas for distribution to the individual valves 20. Each valve 20 is provided with a nozzle 168 that protrudes beyond end wall 34 to be seated in gas-tight manner to a hole in a wall of a respective engine runner 204. Each nozzle 168 communicates the respective outlet port 40 to the respective runner. Hence when a respective valve 20 is operated open, exhaust gas is introduced through it to the respective runner 204 for entrainment with induction flow into the respective engine cylinder. An assembly 160 can provide certain advantages. All valves 20 can be assembled to member 162 and the assembly 160 tested before it is installed in an engine. A single conduit 208 can supply exhaust gas from exhaust system 206 to the manifold provided by member 162, thereby avoiding multiple individual conduits for the multiple individual valves.

Figure 4:
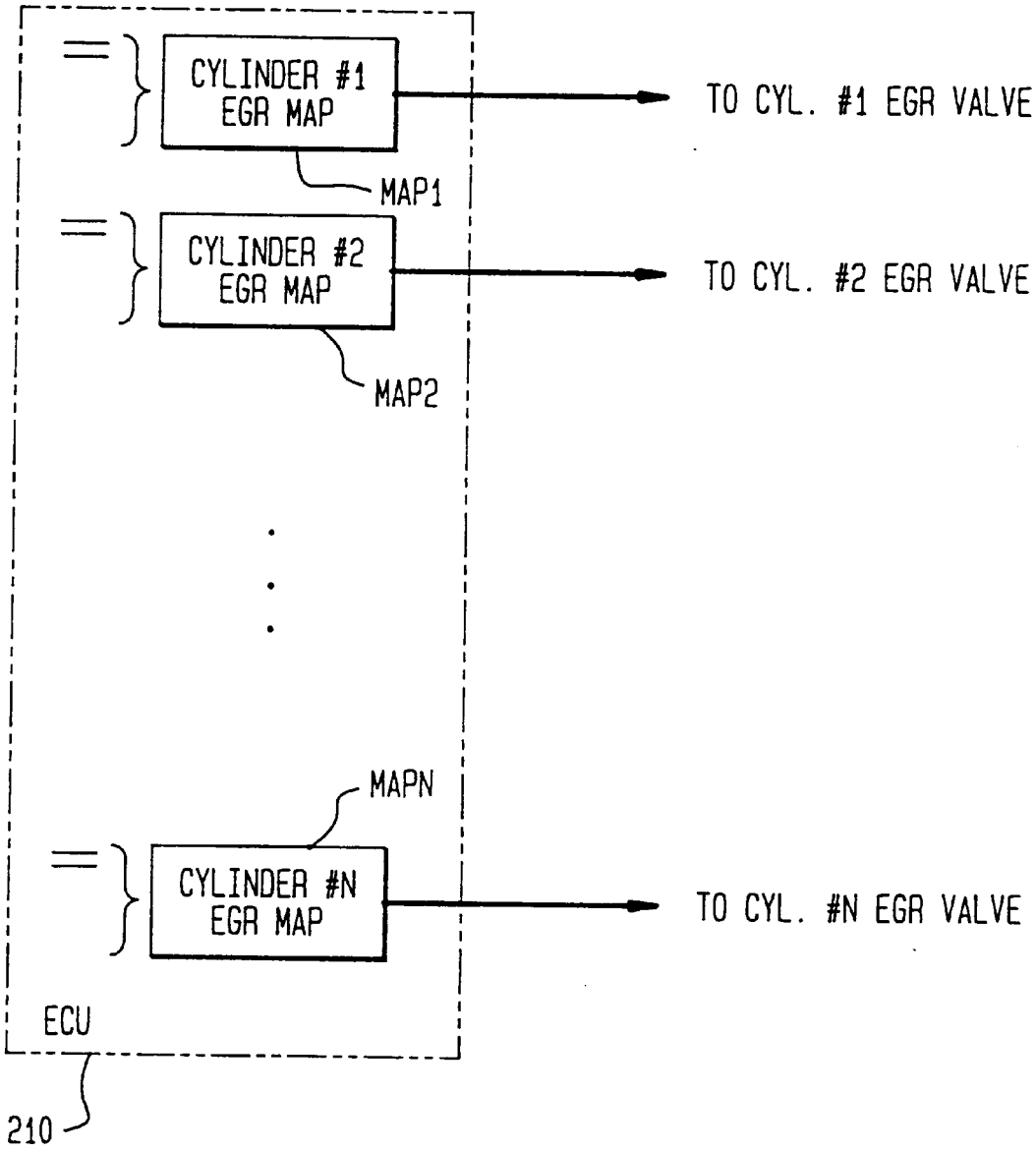
FIG. 4 is a block diagram of a portion of an engine electronic control unit, or ECU, for operating individual injector EGR valves according to requirements for individual engine cylinders.

FIG. 4 shows detail of ECU 210 that adapts individual valves 20 to individual engine cylinders. In certain engines the EGR requirements of individual cylinders may vary from cylinder to cylinder for one or more different reasons. In a mass-produced engine model, the EGR requirements of the engine cylinders may be mapped on the basis of various parameters. A map of each cylinder's requirements for a particular engine model is programmed in ECU 210. These maps are shown by blocks MAP1, MAP2, . . . MAPN, in FIG. 4. Hence, when the engine is operated, various operating parameters are sensed and utilized as inputs to the respective maps to cause the amount of exhaust gas recirculated to each cylinder to be tailored to the particular cylinder's requirements.

Figure 5:
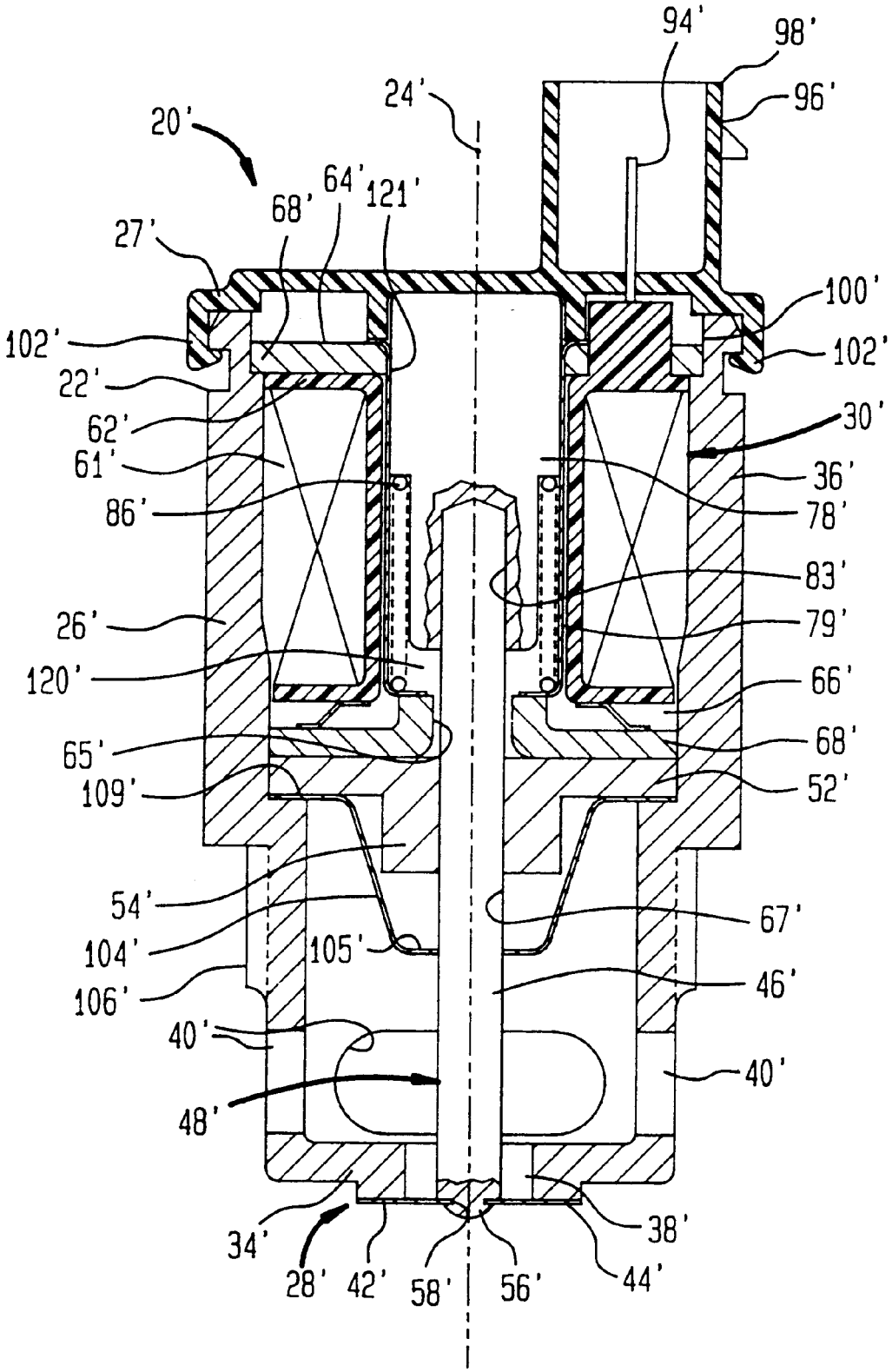
FIG. 5 is a longitudinal cross section view through another embodiment of injector EGR valve used in the injector EGR system of FIG. 1.

FIG. 5 discloses another embodiment of EGR valve 20'. Various component parts of valve 20' correspond either exactly, or closely, to like component parts of valve 20 that have already been described. Such component parts of valve 20' are identified by the same base reference numerals as corresponding component parts of valve 20, but primed. Given the foregoing detailed description of valve 20, detailed description of valve 20' will hereinafter be given only with respect to certain differences between the two embodiments.

In valve 20', the circular lip of end wall 36' that contains valve seat 42' is turned outward, and pin 46' is sufficiently long to allow disk 44' to be disposed on the exterior of shell 26'. Armature 78' has an external shoulder seating one end of spring 86'. The opposite end of spring 86' seats on an inward turned flange at the lower end of sleeve 79', which is in turn supported on the end of an upturned flange of pole piece 66' that circumscribes hole 65'. Spring 86' thereby biases valve element 48' to seat disk 44' closed on seat 42'.

The hole circumscribed by seat 42' is inlet port 38', and the holes in the adjacent side wall of shell 26' form outlet port 40'. When valve 20' is opened by displacing valve element 48' downward from its FIG. 5 position, disk 44' unseats to allow exhaust gas to enter through inlet port 38', pass through the valve, and exit through the holes forming outlet port 40'.

In valve 20', air gap 120' is present between the upturned flange of pole piece 66' and the lower end of armature 78'. The opposite air gap 121' is present between the inside diameter of pole piece 64' and the confronting side of armature 78'. When solenoid actuator 30' is energized by a suitable electric current, armature 78' is displaced downward against the force of spring 86' to open the valve. When the current terminates, the compressed spring relaxes, returning armature 78' upward and closing the valve.

In view of the reversal of the inlet and outlet ports in valve 20' compared to valve 20, it would be understood that the intake runners and exhaust manifold of an engine with which valves 20' are used would be adapted to the port reversal.

It is also to be understood that because the invention may be practiced in various forms within the scope of the appended claims, certain specific words and phrases that may be used to describe a particular exemplary embodiment of the invention are not intended to necessarily limit the scope of the invention solely on account of such use.

What is claimed is:

1. An internal combustion engine having multiple combustion chambers each having intake and exhaust valves for controlling intake and exhaust flows into and from the combustion chamber, an induction system to the intake valves, an exhaust system from the exhaust valves, and an EGR system for controlling recirculation of exhaust flow to the combustion chambers comprising an individual electric-actuated EGR valve associated with each respective combustion chamber for controlling the exhaust recirculation to the respective combustion chamber independent of the exhaust gas recirculated to any other combustion chamber, including an electric controller for controlling each EGR valve individually in relation to at least one input parameter to the electric controller, and in which the electric controller comprises maps of individual combustion chamber EGR requirements and controls the operation of each EGR valve through the respective map.

2. An internal combustion engine having multiple combustion chambers each having intake and exhaust valves for controlling intake and exhaust flows into and from the combustion chamber, an induction system to the intake valves, an exhaust system from the exhaust valves, and an EGR system for controlling recirculation of exhaust flow to the combustion chambers comprising an individual electric-actuated EGR valve associated with each respective combustion chamber for controlling the exhaust recirculation to the respective combustion chamber independent of the exhaust gas recirculated to any other combustion chamber, in which each EGR valve comprises an inlet port that receives exhaust gas through a common conduit communicated to the exhaust system, and including a rail member in which the EGR valves are mounted and which forms a manifold within which the inlet ports are disposed.

3. A method of exhaust gas recirculation in an internal combustion engine having multiple combustion chambers each having intake and exhaust valves for controlling intake and exhaust flows into and from the combustion chamber, an induction system to the intake valves, an exhaust system from the exhaust valves, and an EGR system for controlling recirculation of exhaust flow to the combustion chambers comprising an individual electric-actuated EGR valve associated with each respective combustion chamber for controlling the exhaust gas recirculation to the respective combustion chamber independent of the exhaust gas recirculated to any other combustion chamber, and an electric controller for controlling each EGR valve individually in relation to at least one input parameter to the electric controller, the method comprising controlling individual EGR valve operation through a respective map of the respective combustion chamber's EGR requirements that is contained in the electric controller.

4. An internal combustion engine having multiple combustion chambers, an exhaust system through which exhaust gas is conducted from the combustion chambers, and an exhaust gas recirculation rail assembly mounted on the engine, the exhaust gas recirculation rail assembly comprising an exhaust gas recirculation rail forming an exhaust gas recirculation manifold communicated to the exhaust system, plural electric-actuated EGR valves mounted on the rail, each comprising its own valve body received in a respective receptacle in the rail, each body having an inlet port communicated to the exhaust gas recirculation manifold and an outlet port for recirculation of exhaust gas from the exhaust system to a respective combustion chamber such that recirculation of exhaust gas through each EGR valve is controlled independent of the exhaust gas recirculated through the other EGR valves.

5. An internal combustion engine as set forth in claim 4 in which the exhaust gas recirculation manifold is communicated to the exhaust system through a common conduit.

6. An EGR valve comprising a ferromagnetic shell comprising a cylindrical side wall, a transverse end wall at an axial end of the side wall, the end wall containing a valve seat circumscribing a first port, a second port in the side wall proximate the end wall, a valve element that is selectively positionable relative to the valve seat to selectively control EGR flow between the two ports, the side wall comprising an internal shoulder spaced beyond the second port relative to the end wall, a shield disposed within the shell and having an outer margin seated on the shoulder and an inner margin circumscribing the valve element, the inner margin being spaced toward the end wall relative to the outer margin, a bearing guide disposed within the shell seated on the outer margin of the shield and providing guidance for the valve element, a first ferromagnetic pole piece disposed within the shell against the bearing guide, an electromagnet coil disposed within the shell beyond the first pole piece relative to the bearing guide, a second ferromagnetic pole piece disposed within the shell and cooperating with the first pole piece to axially capture the coil, and with the shell side wall, form a solenoid, the solenoid further comprising an armature reciprocal within the coil and joined to the valve element, and a cap closing the end of the shell opposite the end wall.

7. An EGR valve as set forth in claim 6 including a non-ferromagnetic sleeve within which the armature is reciprocal.

8. An exhaust gas recirculation rail assembly comprising an exhaust gas recirculation rail forming an exhaust gas recirculation manifold adapted to be communicated to exhaust gas from an internal combustion engine, plural electric-actuated EGR valves mounted on the rail, each comprising its own valve body received in a respective receptacle in the rail, each body having an inlet port communicated to the exhaust gas recirculation manifold and an outlet port, each outlet port adapted to be communicated to a respective engine combustion chamber to provide for controlled recirculation of exhaust gas to a respective combustion chamber independent of exhaust gas recirculated to other combustion chambers.

9. An exhaust gas recirculation rail assembly as set forth in claim 8 in which each EGR valve comprises a ferromagnetic shell comprising a cylindrical side wall, a transverse end wall at an axial end of the side wall, the end wall containing a valve seat circumscribing the outlet port, the inlet port being disposed in the side wall proximate the end wall, a valve element that is selectively positionable relative to the valve seat to selectively control EGR flow between the two ports, the side wall comprising an internal shoulder spaced beyond the inlet port relative to the end wall, a shield disposed within the shell and having an outer margin seated on the shoulder and an inner margin circumscribing the valve element, the inner margin being spaced toward the end wall relative to the outer margin, a bearing guide disposed within the shell seated on the outer margin of the shield and providing guidance for the valve element, a first ferromagnetic pole piece disposed within the shell against the bearing guide, an electromagnet coil disposed within the shell beyond the first pole piece relative to the bearing guide, a second ferromagnetic pole piece disposed within the shell and cooperating with the first pole piece to axially capture the coil, and with the shell side wall, form a solenoid, the solenoid further comprising an armature reciprocal within the coil and joined to the valve element, and a cap closing the end of the shell opposite the end wall.

10. An exhaust gas recirculation rail assembly as set forth in claim 8 in which the rail member is integrated with an engine intake manifold.

* * * * *